US009297180B1

(12) United States Patent
Tumamao

(10) Patent No.: US 9,297,180 B1
(45) Date of Patent: Mar. 29, 2016

(54) FENCE JIG

(71) Applicant: Eric Tumamao, Lahaina, HI (US)

(72) Inventor: Eric Tumamao, Lahaina, HI (US)

( * ) Notice: Subject to any disclaimer, the term of this patent is extended or adjusted under 35 U.S.C. 154(b) by 50 days.

(21) Appl. No.: 14/450,774

(22) Filed: Aug. 4, 2014

Related U.S. Application Data

(60) Provisional application No. 61/950,465, filed on Mar. 10, 2014.

(51) Int. Cl.
*E04H 17/26* (2006.01)
*G01B 5/14* (2006.01)

(52) U.S. Cl.
CPC . *E04H 17/26* (2013.01); *G01B 5/14* (2013.01)

(58) Field of Classification Search
CPC ..... E04H 17/26; G01B 5/14
USPC ..... 33/613, 645
See application file for complete search history.

(56) References Cited

U.S. PATENT DOCUMENTS 4,583,274 A * 4/1986 Moracz ..... B23P 15/04 228/182
5,002,437 A * 3/1991 Giroux ..... B25B 11/02 29/464
5,491,905 A * 2/1996 Jablonski ..... E04G 21/1891 33/481
5,628,119 A * 5/1997 Bingham ..... E04G 21/1891 269/904
7,377,489 B1 5/2008 Houseman
7,455,089 B2 11/2008 McDaniel et al.
7,726,037 B1 * 6/2010 Jordan ..... E04H 17/20 33/613
2002/0095813 A1 7/2002 Tatarnic
2010/0229415 A1 * 9/2010 Knudsen ..... G01D 1/00 33/613
2013/0214227 A1 * 8/2013 Salisbury ..... E04H 17/14 256/24
2015/0113791 A1 * 4/2015 Clark ..... B25B 5/102 29/559

FOREIGN PATENT DOCUMENTS

EP 0130685 A1 1/1985
EP 0162402 A1 11/1985
EP 0526138 A2 2/1993
WO 2008057387 A2 5/2008

OTHER PUBLICATIONS http://anawhite.com/sites/default/files/jig%20diagram%20raised%20panel %20door%20how%20to%202.jpg.
http://www.woodworking.com/Resource.ashx?sn=LegTaperJig1.
http://images.meredith.com/wood/images/2008/05/p_panel-pushing- jig.jpg.

* cited by examiner

*Primary Examiner* — G. Bradley Bennett
(74) *Attorney, Agent, or Firm* — Robert C Montgomery; Montgomery Patent LLC

(57) ABSTRACT

A fence jig is provided for assisting construction of privacy fences. The fence jig includes an elongated board that is the length of a fence post. Attached to that board is a post guide that fits on the fence post. First, second, and third flanges are attached to the board with dimensions that place gaps between the flanges where fence connectors should be located when the post guide rests on a fence post. The fence jig also provides reference edges and power saw cutting guides for accurately cutting fence panels.

14 Claims, 7 Drawing Sheets

FENCE JIG

RELATED APPLICATIONS

This application claims the benefit of U.S. Provisional Application No. 61/950,465, which was filed Mar. 10, 2014, the entire disclosures of which are incorporated herein by reference.

FIELD OF THE INVENTION

The presently disclosed subject matter relates to installing fencing. More particularly, the present invention relates to a fence installation jig.

BACKGROUND OF THE INVENTION

There are many home improvement projects a home owner can undertake to update and beautify their homes. One (1) of the most popular and useful is fencing. A fence can enhances the aesthetic beauty of a home and its landscaping, serve as a boundary for children and pets, act as a deterrent for trespassers, and help maintain good relationships with neighbors.

Modern fencing takes many forms. Picket fences, chain link fences, wood fences, and vinyl fences are all widely available. Modern fencing provides home owners with a variety of styles, quality construction, and years of services with little or no maintenance. However, actually constructing a fence tends to be time consuming and is very labor intensive. For example, vinyl fences are usually constructed of vinyl fence panels that are attacked to fence posts. In the prior art constructing a vinyl fence required one to carefully measure and then re-measure a cut before actually making that cut. A mistake was costly both in time and materials. Additionally, in the prior art it was often difficult to determine accurate locations where vinyl fence connectors needed to be located when attaching each panel. Wood privacy fences had similar problems.

In view of the foregoing there exists a need for a device that makes construction of vinyl and privacy fencing easier, faster, and simpler.

SUMMARY OF THE INVENTION

The principles of the present invention provide for a jig that makes construction of privacy fencing such as those made of vinyl and wood easier, faster, and simpler.

A fence jig that is in accord with the present invention includes an elongated board having a planar fence face and a planar post face opposite the fence face. A rip edge extends between the fence face and the post face and an outer edge is located opposite the rip edge. The board further includes a top edge and a bottom edge. The fence jig also includes a post guide that attached to the board top edge and which perpendicularly projects out the said post face to form an under face. A first flange is attached to the fence face. The first flange has a first flange board face in contact with the fence face, a first flange fence face opposite the first flange board face, a top edge above the first flange board face and the first flange fence face, a first flange rip edge on the left of the first flange board face; a first bracket upper edge opposite the top edge, and the thickness of a stringer of a fence being constructed.

The fence jig also includes a second flange attached to the fence face, the second flange having a second flange board face in contact with the fence face, a second flange fence face opposite the second flange board face, a first bracket lower edge above the second flange board face and the second flange fence face, a second flange rip edge to the left of the second flange board face; a second bracket upper edge opposite the first bracket lower edge, and the thickness of a stringer of a fence being constructed.

The Fence Jig also includes a third flange attached to the fence face. The third flange having a third flange board face in contact with the fence face, a third flange fence face opposite the third flange board face, a second bracket lower edge above the third flange board face and the third flange fence face, a third flange rip edge to the left of the third flange board face; and a second flange bottom edge opposite the second bracket lower edge, and the thickness of a stringer of a fence being constructed.

In practice, the post guide is placed on top of a fence post with the post face in contact with that fence post. Then the first bracket upper edge is located where the top of a "U"-shaped bracket should go.

In addition, the fence jig can include a first spacer that attached to the post face and to the under face to form a first reference edge, a second spacer attached to the post face to form second reference edge, and a third spacer attached to the post face to form a third reference edge such that the first reference edge, the second reference edge, and the third reference edge are coplanar.

BRIEF DESCRIPTION OF THE DRAWINGS

The advantages and features of the present invention will become better understood with reference to the following more detailed description and claims taken in conjunction with the accompanying drawings in which like elements are identified with like symbols and in which:

DESCRIPTIVE KEY

Figure 1:
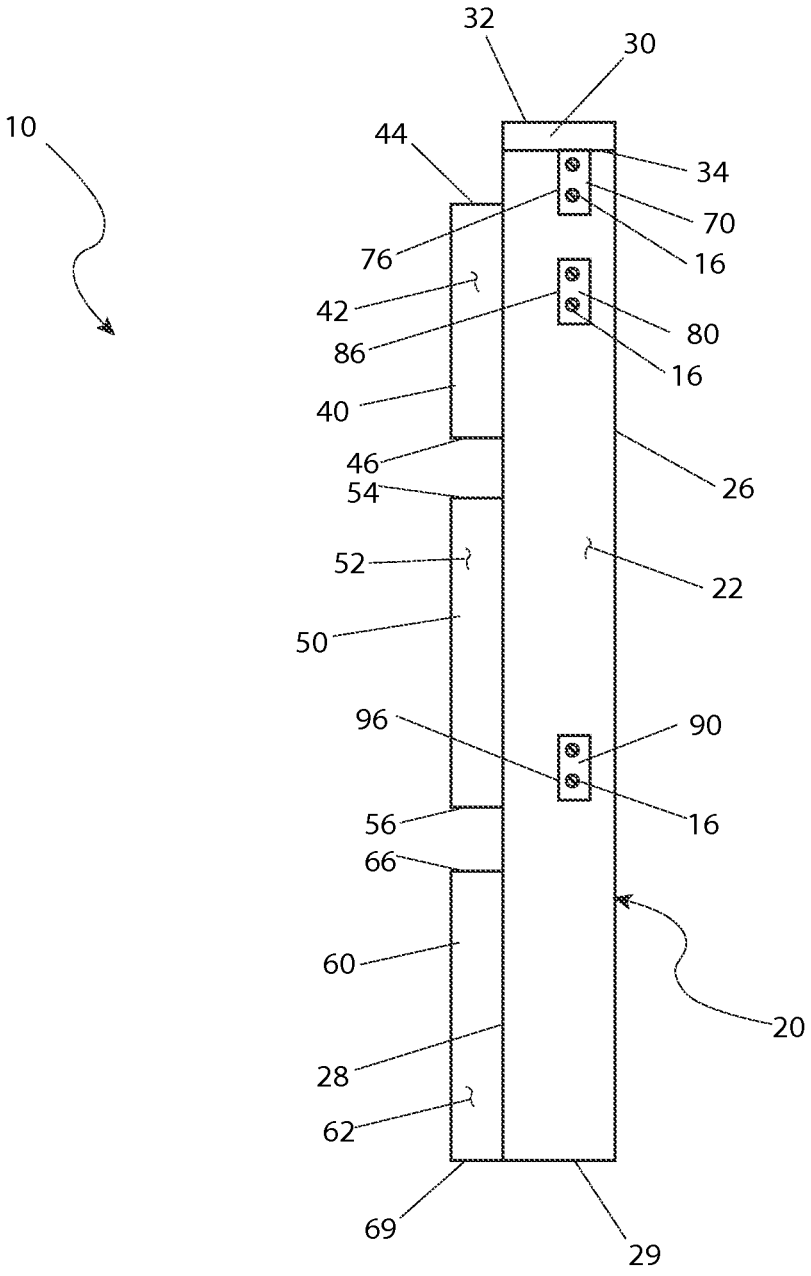
FIG. 1 is a front elevation view of a Fence Jig 10 that is in accord with the preferred embodiment of the present invention.

10 fence jig
16 threaded fastener
20 board
22 post face
24 fence face
26 outer edge
28 rip edge
29 bottom edge
30 post guide
32 top face
34 under face
40 first flange
42 first flange board face
43 first flange fence face
44 top edge
46 first bracket upper edge
48 first flange rip edge

50 second flange
52 second flange board face
53 second flange fence face
54 first bracket lower edge
56 second bracket upper edge
58 second flange rip edge
60 third flange
62 third flange board face
63 third flange fence face
66 second bracket lower edge
68 third flange rip edge
69 third flange bottom edge
70 first spacer
76 first reference edge
80 second spacer
86 second reference edge
90 third spacer
96 third reference edge
100 post
105 fence panel
110 stringer
115 picket
120 panel fastener
125 first "U"-shaped bracket
130 second "U"-shaped bracket

DETAILED DESCRIPTION OF THE PREFERRED EMBODIMENT

The preferred embodiment of the present invention is depicted within FIGS. 1-7. However, the invention is not limited to what is specifically illustrated and described. A person skilled in the art will appreciate that many other embodiments of the invention are possible without deviating from the basic concept of the invention. Any such work around also falls with the scope of this invention.

The terms "a" and "an" herein do not denote a limitation of quantity, but rather denote the presence of at least one of the referenced items. In addition, unless otherwise denoted all directional signals such as up, down, left, right, inside, outside are taken relative to the illustration shown in FIG. 1.

Referring now to FIGS. 1 and 5*a*-7, the present invention describes a fence jig 10 which aids in the installation of a privacy fence. That fence is fabricated from vinyl (or wood) fence panels 105 which are guided into place by the fence jig 10 when attaching a first "U"-shaped bracket 125 and a similar second "U"-shaped bracket 130 to a previously erected fence post 100. The fence jig 10 also acts as a guide when adjusting the width and/or height of the fence panels 105.

Figure 5B:
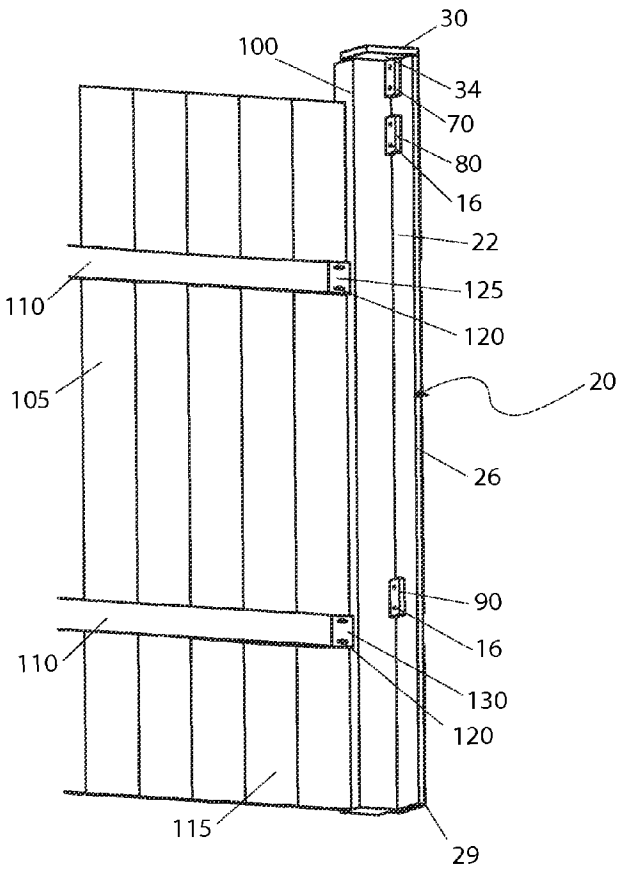
FIG. 5*b* is an isometric view from an opposite perspective of FIG. 5*a* of a fence jig 10 on a fence post 100.
Figure 5A:
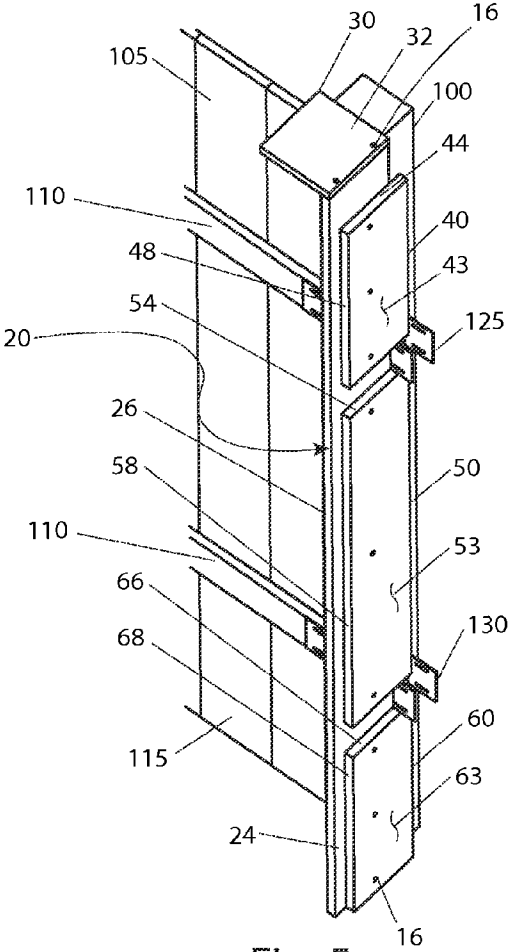
FIG. 5*a* is an isometric view of the fence jig 10 on a fence post 100 as used for locating a first "U"-shaped bracket 125 and a second "U"-shaped bracket 130.

Referring now specifically to FIGS. 5*a* and 5*b*, each fence panel 105 is usually provided as a pre-fabricated structure that typically measures sixty eight inches (68 in.) in length and sixty eight inches (68 in.) in height. Each fence panel 105 is composed of twelve (12) individual pickets 115 that are attached together on both sides by two (2) stringers 110. To install the fence panel 105 the stringers 110 are attached to pre-installed fence posts 100 using panel fasteners 120 that are inserted into an upper first "U"-shaped bracket 125 and into a lower second "U"-shaped bracket 130. The fence posts 100 are preferably seventy two inches (72 in.) in height and will usually have some portion buried underground as required to meet applicable local building codes.

Figure 2:
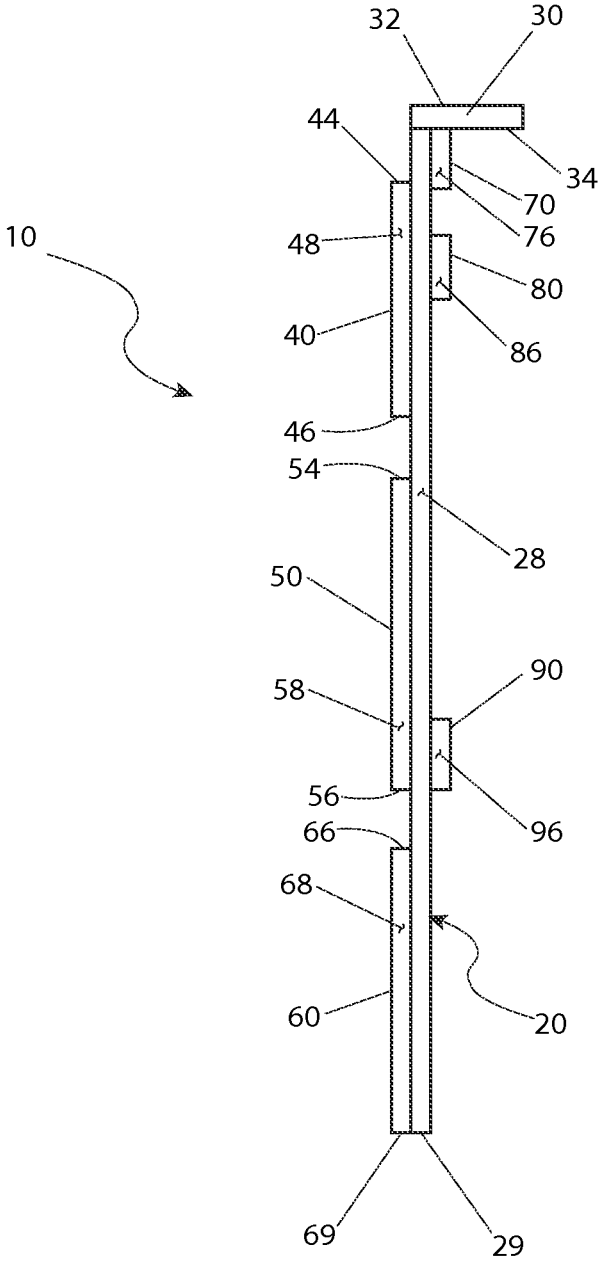
FIG. 2 is a side elevation view of the fence jig 10.
Figure 3:
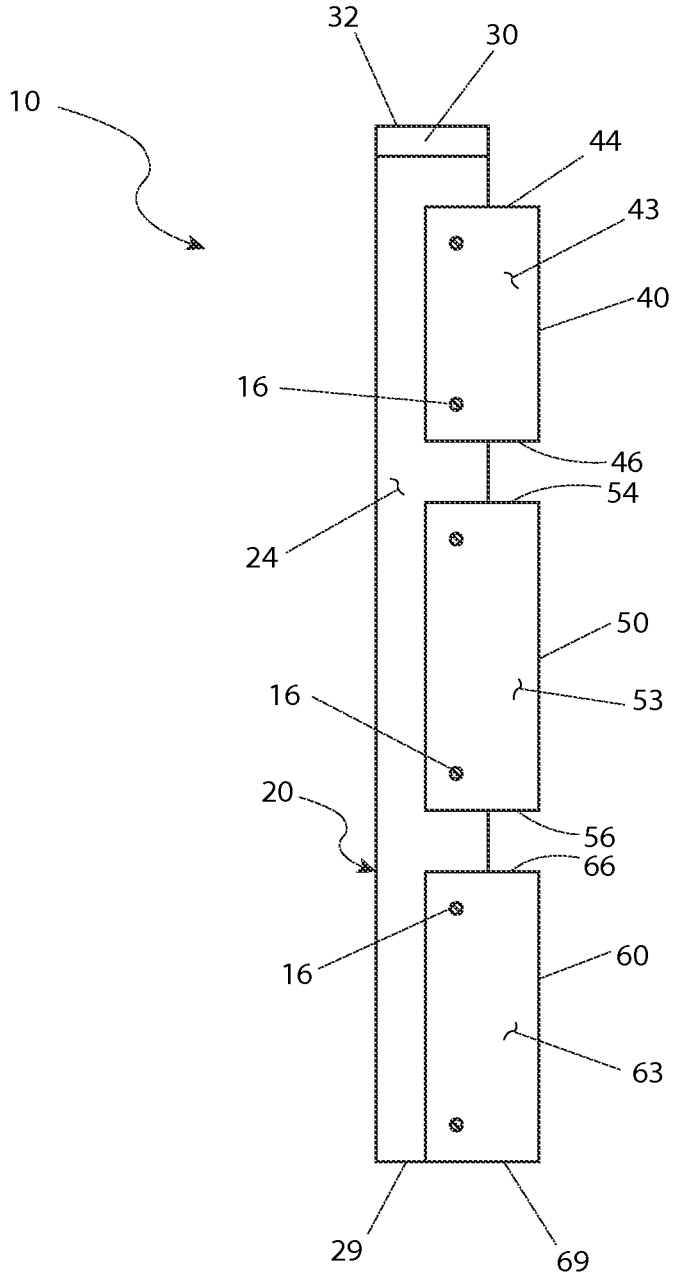
FIG. 3 is a rear elevation view of the fence jig 10.
Figure 4:
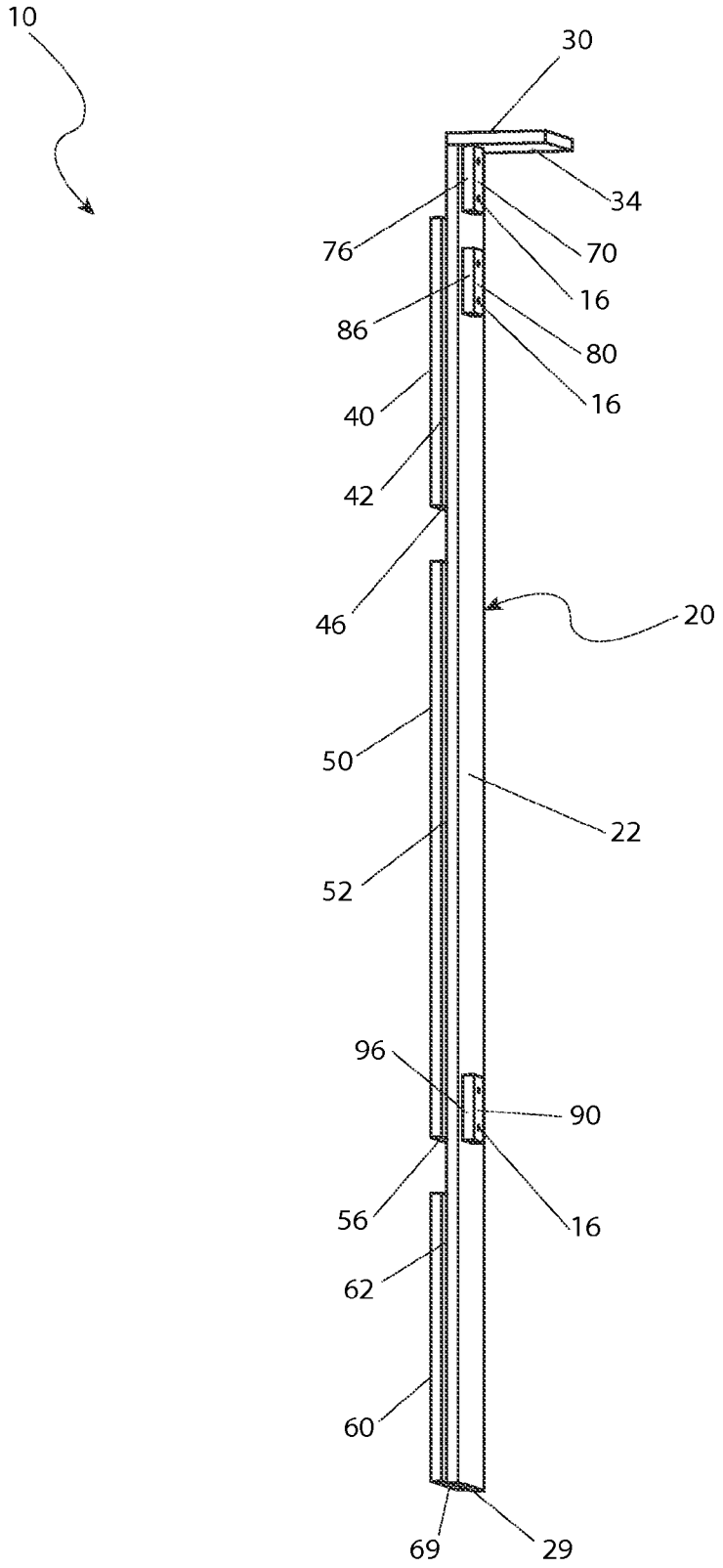
FIG. 4 is an isometric view of the fence jig 10.

FIG. 1 presents a front elevation view, FIG. 2 presents a side elevation view, FIG. 3 presents a rear elevation view, and FIG. 4 presents an isometric view of the fence jig 10. The fence jig 10 includes a board 20 and a top post guide 30. The board 20 is the central part of the fence jig 10 to which other pieces are attached. The board 20 and the post guide 30 are preferably composed of wood or vinyl. Other materials, such as composite materials, other thermoplastics, and metal, may also be used. The board 20 is both flat and straight with straight edges. The board 20 is typically about seventy two inches (72 in.) long to correspond to the height of a fence post 100. The face showing in FIG. 1 is designated as the post face 22. The post face 22 is the face which is placed against a fence post 100 when the fence jig 10 is being used to attach fence panels 120. The face opposite the post face 22 is the fence face 24; specifically reference FIG. 3. The long edge on the left side of the board 20 as seen in FIG. 1 is the rip edge 28. The rip edge 28 acts as a guide for a power saw that is used to make cuts to a fence panel 105 when making width adjustments to fit the fence panel 105 to a fence post 100. The long edge opposite the outside edge 26 is the rip edge 28. The short edge at a bottom of the board 20 is the bottom edge 29.

The post guide 30 is a square piece that projects over the front of the board 20 (best shown in FIG. 5*a*). The post guide 30 is attached to the top of the board 20, preferably by adhesive and at least one (1) threaded fastener 16. The face of the post guide 30 in contact with the board 20 is the under face 34 while the upper face is the top face 32.

Referring again primarily to FIGS. 1-4, attached to the fence face 24 are a first flange 40, a second flange 50, and a third flange 60. Attachment is preferably made using adhesive and threaded fasteners 16; see FIG. 3. The first flange 40, the second flange 50, and the third flange 60 are preferably made of the same material as the board 20. In any event they have the same thickness as the stringers 110. The surface of the first flange 40 in direct contact with the fence face 24 is the first flange board face 42. The opposite surface of the first flange 40 is the first flange fence face 43. In use the first flange fence face 43 is placed against a fence panel 105 when using the fence jig 10. The narrow edge of the first flange 40 closest to the post guide 30 is the top edge 44. The narrow edge of the first flange 40 opposite that is the first bracket upper edge 46. The first bracket upper edge 46 contacts the top of the first "U"-shaped bracket 125 when fastening a first "U"-shaped bracket 125 to a fence post 100. The left side long edge of the first flange 40 is the first flange rip edge 48 (see FIG. 2). This first flange rip edge 48, along with corresponding edges on the second flange 50 and the third flange 60, acts as a guide for a power saw when making height adjustment cuts to fence panels 105 to make them properly fit between fence posts 100. The first flange 40 is attached to the board 20 at a location which places the first "U"-shaped bracket 125 at the correct height on the fence post 100 to engage the top stringers 110 of fence panels 105 when the post guide 20 is on top of a fence post 100 and the first bracket upper edge 46 is adjacent the upper surface of a first "U"-shaped bracket 125.

The second flange 50 has similar faces and long edges as the first flange 40. Specifically, a second flange board face 52, a second flange fence face 53, and a second flange rip edge 58. The third flange 60 is also configured similarly with a third flange board face 62, a third flange fence face 63, and a third flange rip edge 68. The upper narrow edge of the second flange 50 is the first bracket lower edge 54. The narrow edge of the second flange 50 is the second bracket upper edge 56. The length of the second flange 50 corresponds to the distance between the upper stringer 110 and the lower stringer 110 on the fence panel 105. The upper narrow edge of the third flange 60 is the second bracket lower edge 66. The edge opposite the second bracket lower edge 66 is the third flange bottom edge 69. The third flange 60 is attached to the bottom of the board 20. The length of the third flange 60 corresponds to the distance between a lower stringer 110 on a fence panel 105 and grade level.

Disposed on the post face 22 are a first spacer 70, a second spacer 80, and a third spacer 90. Each of the spacers 70, 80, 90 is about three inches (3 in.) high and two inches (2 in.) wide. The first spacer 70, the second spacer 80, and the third spacer 90 are attached to the board 20, preferably by adhesive and threaded fasteners 16. The upper surface of the first spacer 70 is attached to the under face 34 of the post guide 30. The left edge of the first spacer 70 is a first reference edge 76. The second spacer 80 is attached to the board 20 approximately two inches (2 in.) below the first spacer 70. The left edge of the second spacer 80 is a second reference edge 86. The third spacer 90 is attached to the board 20 approximately forty-one inches (41 in.) below the second spacer 80. The left edge of the third spacer 90 is a third reference edge 96. The first reference edge 76, the second reference edge 86, and the third reference edge 96 are coplanar and are used to align the rip edge 28 of the board 20 with the correct lateral location for a first "U"-shaped bracket 125 and a second "U"-shaped bracket 130 when the under face 34 of the post guide 30 is placed on top of a fence post 100 and the reference edges 76, 86, and 96 are in contact with fence post 100.

Refer now to FIG. 5*a* for an isometric view of the fence jig 10 on a fence post 100, to FIG. 5*b* for an isometric view of the fence jig 10 from another perspective, and to FIG. 3. In FIG. 5*a* the fence jig 10 is shown in use locating a first "U"-shaped bracket 125 at the correct location. The top guide 30 is placed on the top of the fence post 100 with the first spacer 70, second spacer 80, and the third spacer 90 flush against the fence post 100. When so arranged the first "U"-shaped bracket 125 is set in place by locating it on the inner face of the rip edge 28 between the first bracket upper edge 46 and the first bracket lower edge 54. The first "U"-shaped bracket 125 is then attached to the fence post 100 using one or more fasteners 120. A second "U"-shaped bracket 130 is then located on the fence post 100 by placing the second "U"-shaped bracket's "U"-shape against the inner face of the rip edge 28 between the second bracket upper edge 56 and the second bracket lower edge 66. The second "U"-shaped bracket 130 is then attached to the fence post 100 using one or more fasteners 120. Another first "U"-shaped bracket 125 and another second "U"-shaped bracket 130 can be located and attached to the opposite side of the post by moving the fence jig 10 to the opposite side and then repeating the process.

Figure 6:
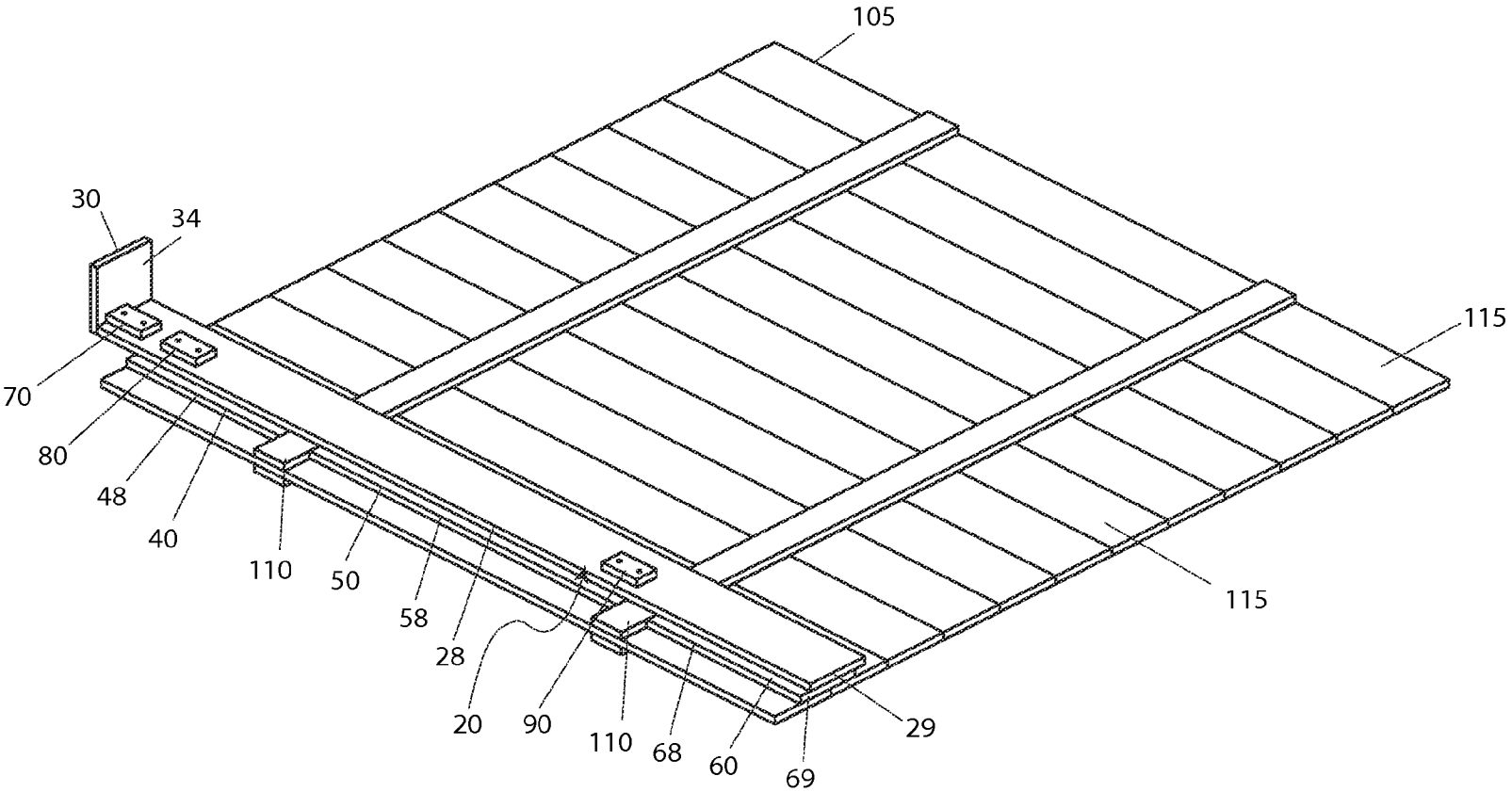
FIG. 6 is an isometric view of a fence jig 10 on a fence panel 105 as used for preparing for a width trimming cut; and, FIG. 7 is an isometric view of the fence jig 10 on a fence panel 105 as used for preparing a height trimming cut.

Refer now to FIG. 6 for an isometric view of the fence jig 10 used on a fence panel 105 and to FIG. 4 for details of the fence jig 10. During the installation of the fence the standard length of the fence panel 105 may exceed the distance between adjacent fence posts 100. In that case the fence panel 105 needs to be cut to fit. The fence jig 10 can assist this cutting. To do so the fence panel 105 is positioned on a stable horizontal work surface with the excess length overhanging the supports. The fence jig 10 is placed on the fence panel 105 with the fence face 24 in contact with the fence panel 105. The upper stringer 110 is between the first flange 40 and the second flange 50 and the lower stringer 110 is located between the second flange 50 and the third flange 60. The first flange board face 42, the second flange board face 52, and the third flange board face 62 are in the same plane as the exposed faces of the stringers 110 with the first flange rip edge 48, second flange rip edge 58 and third flange rip edge 68 aligned with the desired cut line on the fence panel 105. A saw is then run along the fence panel 105 using the rip edge 28 as a guide. The result is a clean, straight cut across the length of the fence panel 105. In practice the fence jig 10 may be clamped to the fence panel 105 to keep the fence jig 10 in place.

Figure 7:
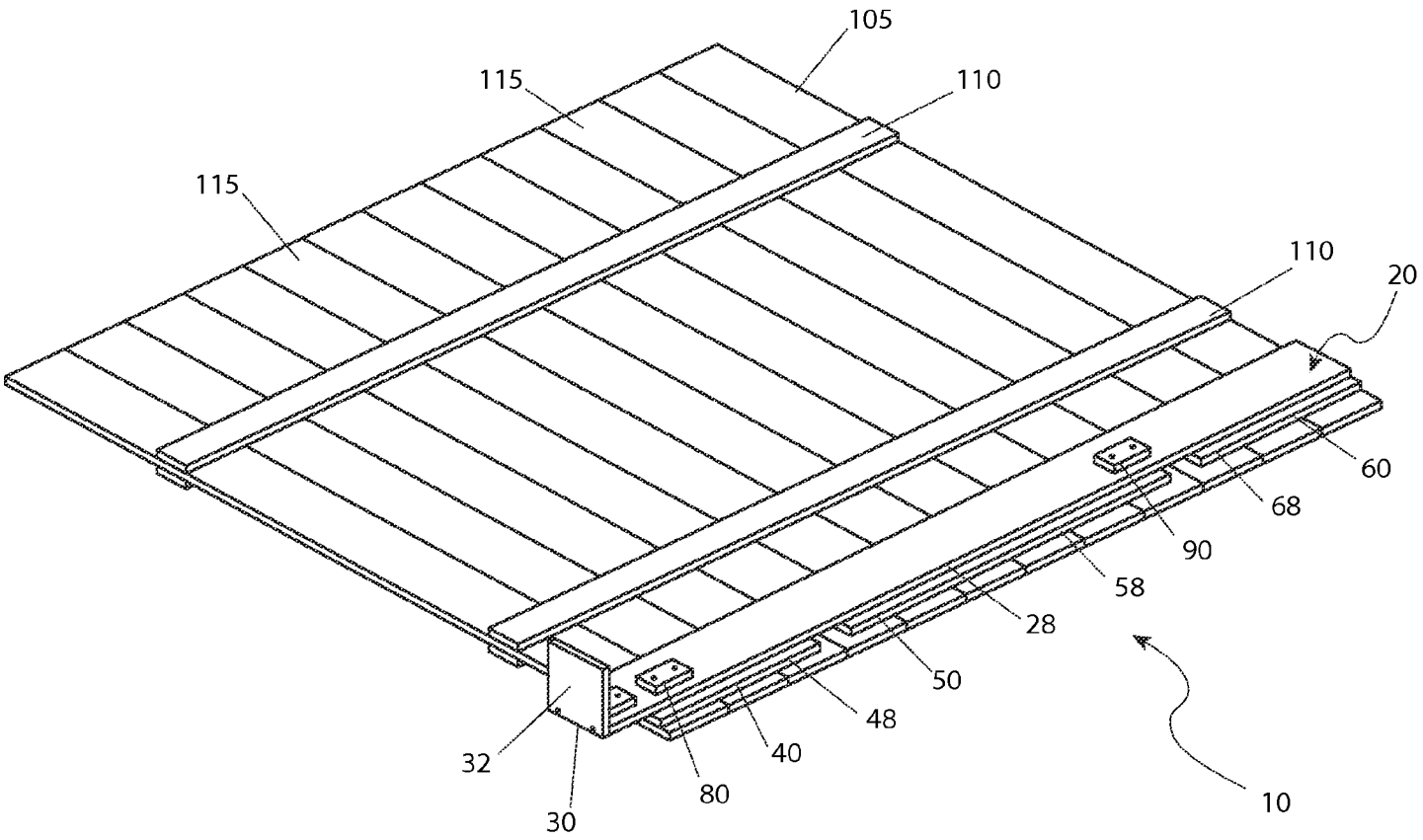

Refer now to FIG. 7 for an isometric view of the fence jig 10 on a fence panel 105 being used to adjust the height of a fence panel 105. In some applications the height of a fence panel 105 may need to be adjusted by cutting. The fence jig 10 assists this cutting. To do so the fence panel 105 is positioned on a stable horizontal work surface with the excess height overhanging the supports. The fence jig 10 is placed longitudinally on the fence panel 105 with the fence face 24 in contact with the fence panel 105. The fence jig 10 is then aligned with the desired cut line to allow the saw to cut the fence panel by being moved along the first flange rip edge 48, the second flange rip edge 58, and the third flange rip edge 68. In practice the fence jig 10 should be clamped to the fence panel 105 during cutting.

The foregoing descriptions of specific embodiments of the present invention have been presented for purposes of illustration and description. They are not intended to be exhaustive or to limit the invention to the precise forms disclosed, and obviously many modifications and variations are possible in light of the above teaching. The embodiments were chosen and described in order to best explain the principles of the invention and its practical application, to thereby enable others skilled in the art to best utilize the invention and various embodiments with various modifications as are suited to the particular use contemplated.

What is claimed is:

1. A fence jig for assisting attaching a fence post having horizontal stringers to a fence post using "U"-shaped brackets, the fence jig comprising:

an elongated board having a planar fence face and a planar post face located opposite said fence face, a rip edge between said fence face and said post face, an outer edge opposite said rip edge, a board top edge, and a bottom edge;

a post guide attached to said board top edge and perpendicularly projecting out from said post face to form an under face;

a first flange attached to said fence face, said first flange having a first flange board face in contact with said fence face, a first flange fence face opposite said first flange board face, a top edge above said first flange board face and said first flange fence face, a first flange rip edge to the left of said first flange board face; a first bracket upper edge opposite said top edge, and a thickness of a stringer;

a second flange attached to said fence face, said second flange having a second flange board face in contact with said fence face, a second flange fence face opposite said second flange board face, a first bracket lower edge above said second flange board face and said second flange fence face, a second flange rip edge to the left of said second flange board face;

a second bracket upper edge opposite said first bracket lower edge, and said thickness of said stringer; and, a third flange attached to said fence face, said third flange having a third flange board face in contact with said fence face, a third flange fence face opposite said third flange board face, a second bracket lower edge above said third flange board face and said third flange fence face, a third flange rip edge to the left of said third flange board face; a second flange bottom edge opposite said second bracket lower edge, and said thickness of said stringer;

wherein when said post guide is placed on top of a fence post with said post face in contact with that fence post said first bracket upper edge is located where a top of a "U"-shaped bracket should go.

2. The fence jig of claim 1, wherein when said post guide is placed on top of a fence post with said post face in contact with that fence post said first bracket lower edge is located where a bottom of a "U"-shaped bracket should go.

3. The fence jig of claim 2, wherein when said post guide is placed on top of a fence post with said post face in contact with that fence post said second bracket upper edge is located where said top of a "U"-shaped bracket should go.

4. The fence jig of claim 3, wherein when said post guide is placed on top of a fence post with said post face in contact with that fence post said second bracket lower edge is located where said bottom of a "U"-shaped bracket should go.

5. The fence jig of claim 4, further comprising:

a first spacer attached to said post face and to said under face, said first spacer forming a first reference edge;

a second spacer attached to said post face, said second spacer forming a second reference edge; and, a third spacer attached to said attached to said post face, said third spacer forming a third reference edge;

wherein said first reference edge, said second reference edge, and said third reference edge are coplanar.

6. The fence jig of claim 5, wherein said first reference edge, said second reference edge, and said third reference align said rip edge with the lateral location for a first "U"-shaped bracket when the under face is placed on top of a fence post with said first reference edge, said second reference edge, and said third reference in contact with that fence post.

7. The fence jig of claim 4, wherein a length of said second flange corresponds to the distance between two stringers.

8. The fence jig of claim 7, wherein a length of said third flange corresponds to the distance between the lowest stringer and grade level.

9. The fence jig of claim 8, wherein said board is vinyl.

10. The fence jig of claim 1, wherein when said fence jig is placed on a fence panel with said fence face in contact with said fence panel with a stringer between said first flange and said second flange and with said first flange rip edge, said second flange rip edge and said third flange rip edge aligned with a desired cut line on said fence panel, said fence jig can guide a saw across a length of said fence panel.

11. The fence jig of claim 1, wherein when said fence jig is placed longitudinally on a fence panel with said fence face in contact with said fence panel and said fence jig is aligned with a desired cut line said first flange rip edge, said second flange rip edge and said third flange rip edge provide a cutting guide for a saw.

12. The fence jig of claim 1, wherein said board is a length of a fence post.

13. The fence jig of claim 1, wherein said board is wood.

14. The fence jig of claim 1, wherein said post guide is attached to said board using adhesive.

* * * * *